US007156000B2

(12) United States Patent
Wroblewski

(10) Patent No.: US 7,156,000 B2
(45) Date of Patent: Jan. 2, 2007

(54) ELECTRICAL CONDUIT CONNECTOR LOCKNUT WRENCH

(76) Inventor: Lucien J. Wroblewski, 1201 Woodcrest Dr., Downers Grove, IL (US) 60516

( * ) Notice: Subject to any disclaimer, the term of this patent is extended or adjusted under 35 U.S.C. 154(b) by 212 days.

(21) Appl. No.: 10/803,421

(22) Filed: Mar. 18, 2004

(65) Prior Publication Data

US 2004/0237728 A1 Dec. 2, 2004

Related U.S. Application Data

(60) Provisional application No. 60/456,216, filed on Mar. 20, 2003.

(51) Int. Cl.
*B25B 13/02* (2006.01)

(52) U.S. Cl. ..... 81/125.1; 81/119; 81/124.3; 81/186

(58) Field of Classification Search ..... 81/119, 81/124.1, 125.1, 186, 3.55, 176, 177.1; D8/17–28
See application file for complete search history.

(56) References Cited

U.S. PATENT DOCUMENTS

| | | | | |
|---|---|---|---|---|
| D273,454 | S * | 4/1984 | Pyles | D8/28 |
| D404,267 | S * | 1/1999 | Hedin | D8/28 |
| 6,276,240 | B1 * | 8/2001 | Blacklock | 81/119 |
| 6,289,772 | B1 * | 9/2001 | Ying-Wen | 81/119 |
| D473,436 | S * | 4/2003 | Pilatzke et al. | D8/28 |

* cited by examiner

*Primary Examiner*—Lee D. Wilson
*Assistant Examiner*—Anthony Ojini
(74) *Attorney, Agent, or Firm*—Trexler, Bushnell, Giangiorgi, Blackstone & Marr, Ltd

(57) ABSTRACT

A wrench for use in connection with a lock nut including outwardly extending protrusions. The wrench includes a base portion and a finger and an engagement tab extending from the base portion. The finger is spaced from the engagement portion with a recess provided between the finger and the engagement portion. To rotate the nut, the finger is positioned over the top surface of the nut. The engagement tab is angled downwardly relative to the finger to engage the outwardly extending protrusions of the nut.

11 Claims, 8 Drawing Sheets

ELECTRICAL CONDUIT CONNECTOR LOCKNUT WRENCH

BACKGROUND OF THE INVENTION

This invention is generally directed to a wrench which can be used to tighten a locknut on a conduit fitting. Electrical wiring codes in many locations throughout the United States and in other countries stipulate the methods and hardware required to distribute electrical power from an incoming electrical panel to various applications. Many of these codes require wiring enclosure for electrical distribution from the incoming electrical panel to the various applications. The required enclosure is often a thin-wall galvanized steel conduit. This thin-wall conduit is generally available in sizes from ⅜ inch up to 6 inches in diameter. In residential applications, the most commonly used size of conduit is ½ inch for distribution to individual services or outlets. Larger sized conduit, generally up to 2 inches, is used for the main distribution panel, depending on the incoming power amperage and the local electrical code requirements.

An electrical conduit connector provides a mechanical connection of the conduit to the electrical box or panel. A typical prior art electrical conduit connector 20 is shown in FIG. 1. The connector includes a generally cylindrically shaped wall 22. The connector 20 includes a first end 24 and second end 26. A passageway 27 extends through the connector 20 from the first end 24 to the second end 26.

The first end 24 of the connector 20 includes a first protrusion 28 and a second protrusion 30 which extend generally perpendicularly from the outer surface of the wall 22. An aperture 32 is provided through the first protrusion 28 through which the threaded end of a screw 34 is passed. The second protrusion 30 includes an aperture 36. A thread is provided on the wall defining the aperture 36 through the second protrusion 30. The screw 34 is passed through the aperture 32 in the first protrusion 28 and then threadedly engaged with the thread in the aperture 36 of the second protrusion 30.

The first end 24 of the connector 20 has an inner diameter which is larger than the outer diameter of the conduit 40 to which it is to be connected. The first end 24 of the connector 20 is fastened to the conduit 40 by placing an end of the conduit 40 within a portion of the passageway 27 such that the first end 24 of the connector 20 surrounds the end of the conduit 40. The connector 20 is then fastened to the conduit 40 by turning the screw 34 to impart a clamping force on the conduit 40.

The second end 26 of the connector 20 is passed through an aperture in a wall 42 of an electrical box or main panel. The electrical box is generally formed from sheet metal and includes appropriately sized pre-perforated holes through which the second end 26 of the connector 20 is passed. These holes are generally located in the sides or back of the electrical box.

The second end 26 of the connector 20 includes a thread 44 on its outer surface. A threaded retaining nut 46 is mounted to the second end 26 of the connector 20. The threaded retaining nut 46 is threadedly engaged with the connector 20 until the nut 46 contacts the surface 42*a* of the wall 42 of the electrical box. A user continues to rotate the nut 46 until the connector 20 is securely fastened to the electrical box.

Retaining nuts are manufactured by several different companies and include a variety of features and configurations. An example of a prior art lock nut of the type used to secure the connector to the electrical box is shown in FIG. 2. As shown in FIG. 2, the nut 46 is generally annularly shaped and includes a top surface 48*a*, a bottom surface 48*b*, a plurality of radially outwardly extending gripping members 50*a*–50*h* and a plurality of recesses 51*a*–51*h* between the gripping members 50*a*–50*h*.

An inner surface 52 defines an aperture 54 through the axial center of the nut 46. The inner surface 52 includes a thread which mates with the thread 44 on the outer surface of the connector 20.

The gripping members 50*a*–50*h* are approximately equally spaced around the circumference of the nut 46. Each gripping member 50*a*–50*h* includes a first surface 56 extending outwardly from a recess 51, a second surface 58 extending from said first surface 56 and which generally follows the curvature of the nut 46, and a third surface 60 extending outwardly from an adjacent recess 51 to the second surface 58. A leading shoulder 62 and a following shoulder 64 are associated with each gripping member 50. The leading shoulder 62 is defined by the third surface 60 of the gripping member 50 and a recess 51. The following shoulder 64 is defined by the first surface 56 and a recess 51. The shoulders 62, 64 are defined relative to their positions as the nut 46 is tightened on the connector 20. As the nut 46 is tightened on the connector 20, the nut rotates in the direction of the leading shoulders 62 of the gripping members 50 i.e. the leading shoulders 62 "lead" the following shoulders 64. As the nut 46 is loosened from the connector 20, however, the nut 46 rotates in the direction of the following shoulders 64 i.e. the following shoulders 64 "lead" the leading shoulders 62.

The nut 46 can be formed using a metal stamping process. This process results in relatively thin nuts, sometimes as thin as 1/16 of an inch. The nuts 46 can also be formed using a die cast process. Nuts made using a die cast process typically have thicker cross sections, which results in larger and more easily grasped gripping members. Other nuts are of a molded plastic variety. Many of the fasteners have serrations or protrusions which extend from the surface of the nut which contacts the wall of the electrical box. These serrations or protrusion intimately engage the surface of the sheet metal, providing an anti back-up or loosening feature.

A current method of fastening the nut 46 on the electrical connector 20 is to use an electrician's slip joint pliers (also referred to as "channel locks") to attempt to clamp on to the gripping members 50 dispersed around the circumference of the nut 46. One problem with this method, particularly in the case of the stamped metal nuts, is that it is difficult to transfer torque to the nut 46 due to the minimal engagement of the pliers with the gripping members 50 or recesses 51 of the nut 46. The user, therefore, relies on friction and the clamping pressure of the pliers to transfer torque to the nut 46. In the situation where a sheet metal nut is used, the thin nature of the nut, which is immediately adjacent to the side wall of the electrical box, exacerbates the grasping difficulties. Another obstacle encountered with this method is that the connector which is being fastened to the electrical box is typically closely positioned to another connector. When using pliers to tighten the nut, this close proximity adds a significant physical restriction on the degree of rotation that can be achieved before encountering the neighboring connector. Once the neighboring connector is encountered the user must release the pliers and adjust the grip of the pliers for further rotation of the nut 46. Frequent adjustment and re-gripping of the nut is not only time consuming but also frustrating.

Another method currently used to secure the nut 46 to the connector 20 is to use a tool or blade, such as a flat screwdriver, to engage the gripping members 50.

The screwdriver is placed against a following shoulder 64 of a gripping member 50 and an impact is applied at the end of the tool (typically from the palm of one's hand) to apply the tangential force necessary to rotate the nut 46 until the nut 46 is securely fastened to the connector 20. The effectiveness of this approach is relative to the stability of the operator's grasp and the position of the nut 46. For example, this method may not be practical if the nut is situated at the back of the box and is difficult to reach. There are numerous physical obstacles such as, for example, adjacent fittings which can also limit the working environment. In many situations, the application of sufficient amount of torque necessary to prevent loosening, may be extremely difficult.

Another method of securing the nut 46 to the connector 20 is to use a spanner wrench. A spanner wrench typically provides a handle portion, a finger extending from the handle portion, and a protrusion at the outer end of the finger. To tighten the nut, the protrusion at the outer end of the finger is used to engage the following surface of a gripping member. As the user rotates the spanner wrench, forces is applied to the following surface of the gripping member to rotate the nut. One disadvantage of using a spanner wrench is that the protrusion which engages the gripping member is located at the outer end of the finger, therefore, it is difficult for the user to view the alignment between the wrench and the nut.

It is essential that the nut 46 firmly secures the electrical connector 20 to the wall 42 of the electrical box. Disconnection of the nut 46 could possibly lead to fitting disengagement and result in exposed electrical wiring, a serious problem.

OBJECTS AND SUMMARY OF THE INVENTION

A general object of the present invention is to provide a wrench which can be used to secure a nut to a conduit connector.

Another object of the present invention is to provide a wrench which easily transmits torque to the nut through the gripping members of the nut.

A further object of the present invention is to provide a wrench which can be used in a relatively confined area.

Yet a further object of the present invention is to provide a wrench in which proper alignment between the wrench and the nut can be easily observed.

Briefly an in accordance with the foregoing, the present invention discloses a wrench including a finger, a relief and an engagement tab. The engagement tab engages a gripping member of a nut and the finger provides radial support and guidance for the wrench.

BRIEF DESCRIPTION OF THE DRAWINGS

The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENTS

Figure 1:
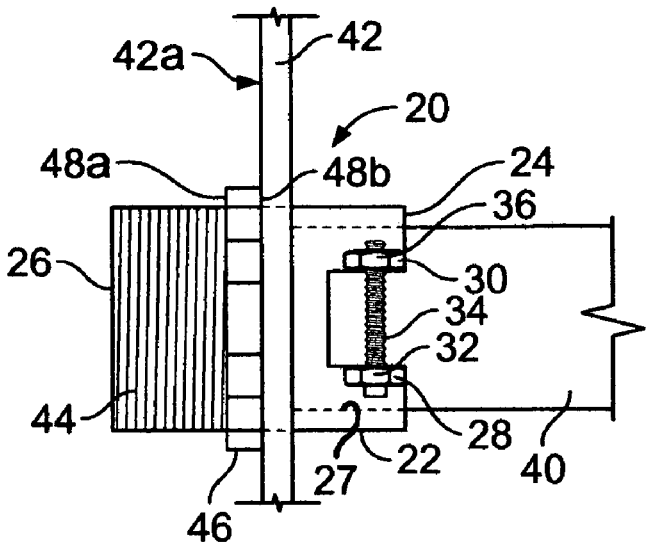
FIG. 1 (Prior Art)
FIG. 1 is an illustration of a conduit connector in accordance with the prior art mounted to the wall of an electrical box with a nut mounted on the threaded end of the connector.

While the invention may be susceptible to embodiment in different forms, there is shown in the drawings, and herein will be described in detail specific embodiments with the understanding that the present disclosure is to be considered an exemplification of the principles of the invention, and is not intended to limit the invention to that as illustrated and described herein.

Figure 3:
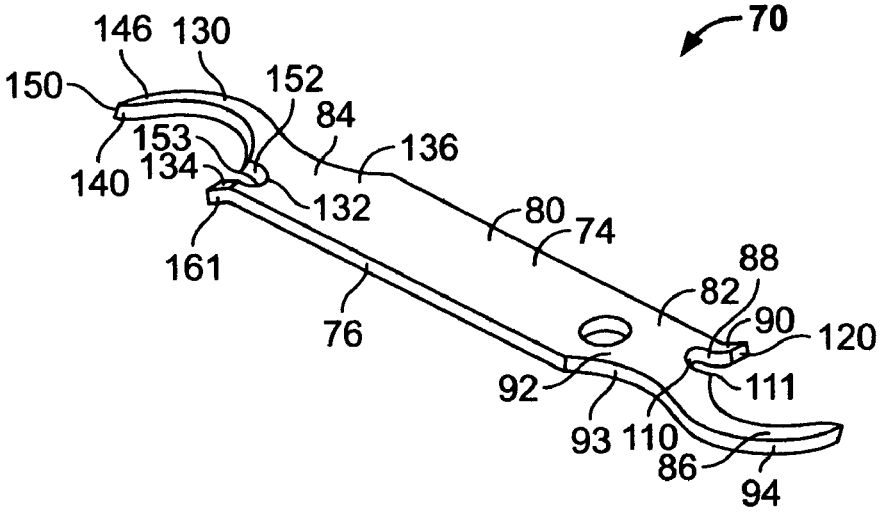
FIG. 3 is a perspective view of a first embodiment of the wrench of the present invention.
Figure 3A:
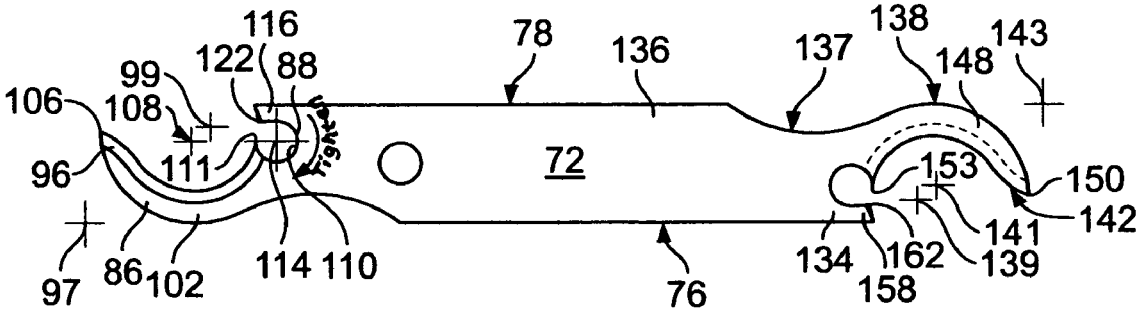
FIG. 3*a* is a top plan view of the wrench of FIG. 3.
Figure 3B:
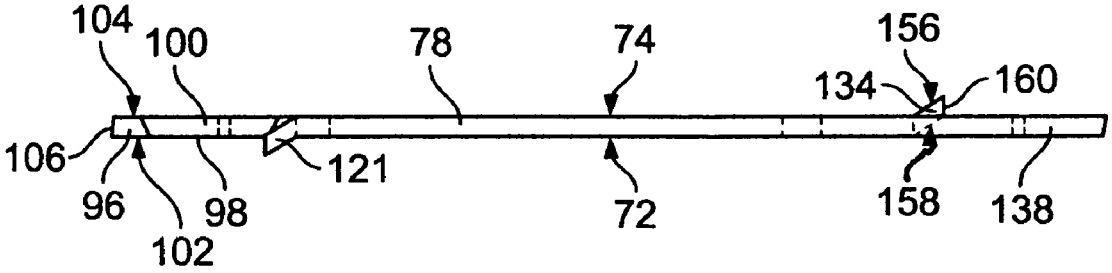
FIG. 3*b* is a front elevational view of the wrench of FIG. 3.
Figure 3C:
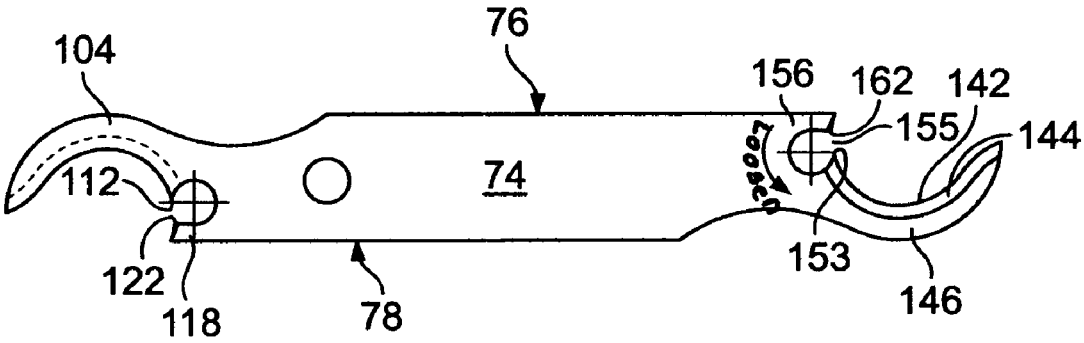
FIG. 3*c* is a bottom plan view of the wrench of FIG. 3.
Figure 3D:
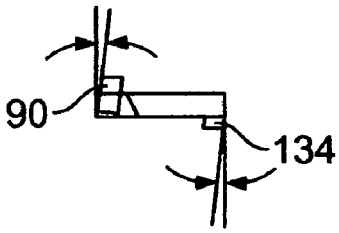
FIG. 3*d* is a left end view of the wrench of FIG. 3.

As shown in FIGS. 3–3*d*, the wrench 70 is an elongated piece and generally includes a handle or base portion 80, a tightening end portion 82 at one end of the handle portion 80 and a loosening end portion 84 at the opposite end of the handle portion 80. The tightening end portion 82 and the loosening end portion 84 are generally coplanar with the handle portion 80. The dimensions described below are preferable dimensions for a ½ inch size wrench.

The handle or base portion 80 of the wrench 70 generally includes a top surface 72, a bottom surface 74, a front surface 76 and a rear surface 78. The top surface 72 is generally parallel to the bottom surface 74 and the front and rear surfaces 76, 78 are generally perpendicular to the top and bottom surfaces 72, 74. The distance between the top surface 72 and the bottom surface 74 is preferably approximately 0.120 inches.

The tightening end portion 82 of the wrench 70 generally includes a transition 92, an arc shaped finger 86, a relief 88, and an engagement tab 90.

The transition 92 extends from the handle portion 80 of the wrench 70.

The transition 92 includes a concave surface 93 which extends from the front surface 76 and which is generally perpendicular to the top and bottom surfaces 72, 74 of the handle portion 80 of the wrench 70.

The finger 86 includes a top surface 102, a bottom surface 104, an outer surface 94, an upright surface 98, and a beveled surface 100.

The top surface 102 of the finger 86 extends from the top surface 72 of handle portion 80 and is generally coplanar with the top surface 72. The bottom surface 104 of the finger 86 extends from the bottom surface 74 of the handle portion 80 of the wrench 70 and is generally coplanar with the bottom surface 74.

The outer surface 94 of the finger 86 is generally perpendicular to the top and bottom surfaces 102, 104 of the finger 86. The outer surface 94 of the finger 86 is generally convex and extends from the concave surface 93 of the transition 92 to the upright surface 98. The outer surface 94 is curved relative to an axial center point 99. Preferably the radius of the curved surface is 0.657 inches.

The upright surface 98 of the finger 86 is generally perpendicular to the top and bottom surfaces 102, 104 of the finger 86 of the wrench 70 and extends upwardly from the bottom surface 104 of the finger 86 and from the outer surface 94 to the relief 88. An end portion 96 of the upright surface 98 extends from the bottom surface 104 to the top surface 102. The end portion 96 is curved relative to an axial center point 97. Preferably the radius of the end portion 96 is approximately 0.500 inches. The upright surface 98 is curved relative to an axial center point 108. Preferably, the radius of the upright surface is approximately 0.440 inches. A tip 106 is provided where the end portion 96 of the upright surface 98 meets the outer surface 94.

The beveled surface 100 extends from the upright surface 98 to the top surface 102 of the finger 86 and from the end portion 96 to the relief 88. The beveled surface 100 is angled relative to the top surface 102. Preferably the beveled surface 100 is angled 60 degrees relative to the top surface 102. The beveled surface 100 is curved relative to the axial center point 108.

The relief 88 includes a curved wall 110. The curved wall 110 extends from the upright and beveled surfaces 98, 100 of the finger 86 to the engagement tab 90. A corner 111 is provided where the upright and beveled surfaces 98, 100 meet the curved wall 110. The curved wall 110 extends approximately 315 degrees about an axial center 114.

The engagement tab 90 includes an upper surface 116, a lower surface 118, an end surface 120, and an outer surface 121. As best shown in FIG. 3*d*, the engagement tab 90 is angled, preferably approximately 10 degrees relative to the rear surface 78.

The upper surface 116 of the engagement tab 90 extends from the top surface 72 of the handle portion 80 of the wrench 70 and is angled relative to the top surface 72. Preferably the angle provided between the top surface 72 of the wrench 70 and the upper surface 116 of the engagement tab 90 is approximately 30 degrees.

The lower surface 118 of the engagement tab 90 extends from the bottom surface 74 of the handle portion 80 of the wrench 70 and is angled relative to the bottom surface 74. Preferably the upper surface 116 of the engagement tab 90 is generally parallel to the lower surface 118 of the engagement tab 90.

The end surface 120 of the engagement tab 90 extends from the upper surface 116 of the engagement tab 90 to the lower surface 118 of the engagement tab 90. The end surface 120 also extends from the curved wall 110 of the relief 88 to the outer surface 121 of the engagement tab 90. An engagement shoulder 122 is provided where the end surface 120 meets the curved wall 110 of the relief 88. A gap 112 is provided between the engagement shoulder 122 and the corner 111.

The outer surface 121 of the engagement tab 90 extends from the rear surface 78 of the handle portion 80 of the wrench 70.

The loosening end portion 84 of the wrench 70 is similar to the tightening end portion 82 of the wrench 70, however, the loosening end portion 84 of the wrench is oriented in a different manner than the tightening end portion 82 of the wrench 70.

The loosening end portion 84 of the wrench 70 generally includes a transition 136, an arc shaped finger 130, a relief 132, and an engagement tab 134.

The transition 136 extends from the handle portion 80 of the wrench 70.

The transition 136 includes a concave surface 137 which extends from the rear surface 78 and is generally perpendicular to the top and bottom surfaces 72, 74 of the handle portion 80 of the wrench 70.

The finger 130 includes a top surface 146, a bottom surface 148, an outer surface 138, an upright surface 142, and a beveled surface 144.

The top surface 146 of the finger 130 extends from the bottom surface 74 of the handle portion 80 and is generally coplanar with the bottom surface 74. The bottom surface 148 extends from the top surface 72 of the handle portion 80 of the wrench 70 and is generally coplanar with the top surface 72.

The outer surface 138 of the finger 130 is generally perpendicular to the top and bottom surfaces 146, 148 of the finger 130. The outer surface 138 of the finger 130 is generally convex and extends from the concave surface 137 of the transition 136 to the upright surface 142. The outer surface of 138 of the finger 130 is curved relative to an axial center point 139.

The upright surface 142 of the finger 130 is generally perpendicular to the top and bottom surfaces 146, 148 of the finger 130 and extends upwardly from the bottom surface 148 of the finger 130 and from the outer surface 138 to the relief 132. An end portion 140 of the upright surface 142 extends from the bottom surface 148 of the finger 130 to the top surface 146 of the finger 130. The end portion 140 of the upright surface 142 is curved relative to an axial center point 143. The upright surface 142 is curved relative to an axial center point 141. A tip 150 is provided where the end portion 140 of the upright surface 142 meets the outer surface 138.

The beveled surface 144 extends from the upright surface 142 to the bottom surface 146 of the finger 130 and from the end portion 140 to the relief 132. The beveled surface 144 is angled relative to the top surface 146. Preferably the beveled surface 144 is angled 60 degrees relative to the top surface 146. The beveled surface 144 is curved relative to the axial center point 141.

The relief 132 includes a curved wall 152. The curved wall 152 extends from the upright and beveled surfaces 142, 144 of the finger 130 to the engagement tab 134. A corner 153 is provided where the upright and beveled surfaces 142, 144 meet the curved wall 152. The curved wall 152 extends approximately 315 degrees about axial center 154.

The engagement tab 134 includes an upper surface 156, a lower surface 158, an end surface 160 and an outer surface 161. As best shown in FIG. 3*d*, the engagement tab 134 is angled, preferably approximately 10 degrees relative to the front surface 76.

The upper surface 156 of the engagement tab 134 extends from the bottom surface 74 of the handle portion 80 of the wrench 70 and is angled relative to the bottom surface 74 of the wrench 70. Preferably the angle provided between the bottom surface 74 of the wrench 70 and the upper surface 156 of the engagement tab 134 is approximately 30 degrees.

The lower surface 158 of the engagement tab 134 extends form the top surface 72 of the handle portion 80 of the wrench 70. And is angled relative to the top surface 72. Preferably the lower surface 158 is generally parallel to the upper surface 156 of the engagement tab 134.

The end surface 160 of the engagement tab 134 extends from the upper surface 156 to the lower surface 158 of the engagement tab 134. The end surface 160 also extends from the curved wall 152 of the relief 132 to the outer surface 161 of the engagement tab 134. An engagement shoulder 162 is provided where the end surface 160 meets the curved wall 152 of the relief 132. A gap 155 is provided between the engagement shoulder 162 and the corner 153.

The outer surface 161 of the engagement tab 134 extends from the front surface 76 of the handle portion 80.

Figure 2:
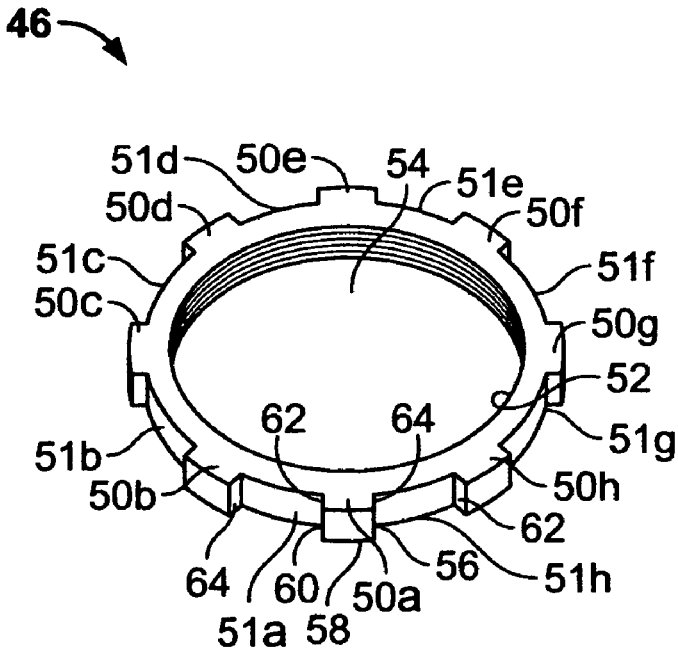
FIG. 2 (Prior Art)
FIG. 2 is a perspective view of a nut for use in connection with a conduit connector.
Figure 4A:
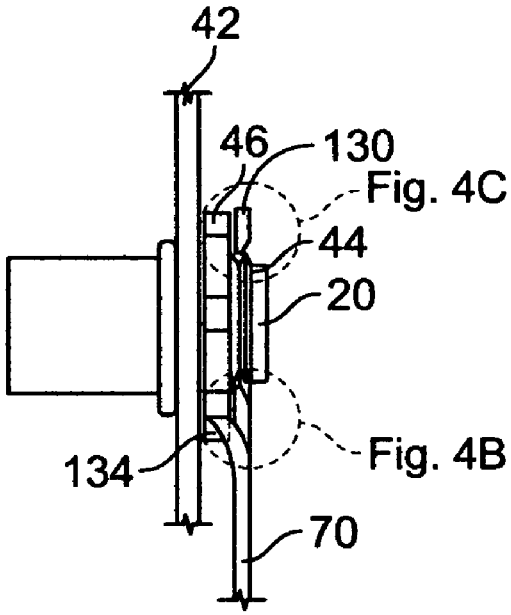
FIG. 4*a* is a side view of the wrench of FIG. 3 along with a nut and connector.
Figure 4B:
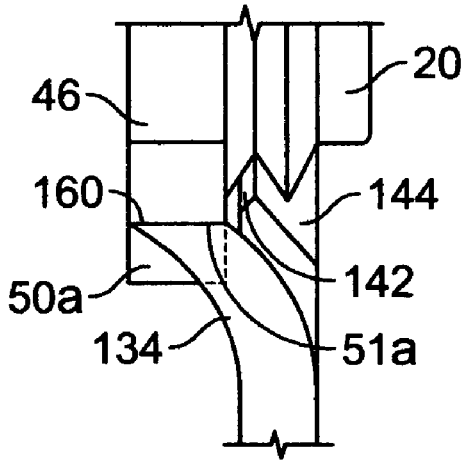
FIG. 4*b* is a detailed view of a portion of FIG. 4*a*.
Figure 4C:
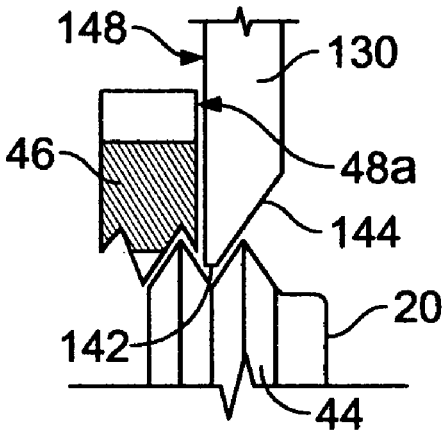
FIG. 4*c* is a detailed view of a portion of FIG. 4*a;*

The wrench 70 is used to tighten or loosen a nut such as, for example, the nut 46 of FIG. 2, to a connector, such as, for example, the connector 20 of FIG. 1. To tighten the nut 46 on the connector 20 the nut 46 is placed on the threaded end 26 of the connecter 20. A user can begin tightening the nut 46 by rotating the nut 46 on the threaded end 26 of the connector 20 using his fingers. Once, the nut 46 becomes difficult to turn with his fingers, the user places the tightening portion 82 of the wrench 70 proximate the nut 46 to be tightened. Before the user contacts the wrench 70 with the nut 46, the user verifies that tightening end portion 82 of the wrench has been selected for use. An identifier 166 can be engraved on the top surface 72 of the wrench 70 to ensure that the user has achieved the proper orientation of the wrench 70. Positioning of the tightening end portion 82 of the wrench 70 with respect to the nut 46 and the connector 20 for the purposes of tightening the nut is similar to the positioning of the loosening end portion 84 of the wrench 70 as shown in FIGS. 4*a*–4*c*.

To tighten the nut, the end surface 120 of the engagement tab 90 is placed against a recess, for example, recess 51*a* of the nut 46. The user then places the finger 86 proximate the nut 46 so that the bottom surface 104 of the finger 86, is positioned above or resting on the upper surface 48*a* of the nut 46. As the user begins to rotate the wrench 70 in the clockwise direction, the engagement tab 90 encounters the gripping member 50*a*. As the user continues to rotate the wrench 70, the engagement shoulder 122 of the engagement tab 90 engages the following shoulder 64 of the gripping member 50*a*. The recess 88 allows the user to visualize the engagement of the shoulder 122 of the engagement tab 90 with the shoulder 64 of the gripping member 50*a*. In addition to the engagement between the engagement tab 90 and the nut 46, the beveled surface 100 and the upright surface 98 engage the threads 44 of the connector 20 such that the upright surface 98 of the finger 86 is positioned proximate the root of the thread 44 of the connector 20. As rotational force is further applied, the wrench 70 reaches a self-locking position relative to the nut 46 and the connector 20. In the self-locking position, the wrench 70 is tightly engaged with the nut 46 and the finger 86 provides radial support and guidance to maintain contact between the engagement tab 90 and the nut 46. It is also often possible, depending upon the particular structure of the nut 46 to be tightened, that when the wrench 70 is placed in the self-locking position, the wrench 70 maintains contact with the nut 46 when the user releases his/her grip from the handle portion 80.

As the user rotates the nut 46 the thread 52 of the nut 46 engages the thread 44 of the connector 20. If an obstruction, such as, for example, a wall of the electrical box or an adjacent connector, is encountered as the user rotates the wrench 70, the user removes the wrench 70 from the nut 46, realigns the wrench 70 with the nut 46 and continues rotation of the nut 46. The transition 92 of the tightening end 82 of the wrench 70 provides additional clearance for rotation of the nut. As a result, the number of adjustments necessary may be reduced. Rotation of the nut continues until the lower surface 48*b* of the nut 46 securely engages the wall 42 of the electrical box.

To loosen the nut 46 from the connector 20, the user begins by placing the loosening end portion 84 of the wrench 70 proximate the nut 46. The user verifies the that the loosening end portion 84 of the wrench 70 has been selected for use. An identifier 168 can be engraved on the bottom surface 74 of the wrench 70 to ensure that the user has achieved the proper orientation of the wrench 70.

As shown in FIGS. 4*a*–4*c*, the end surface 160 of the engagement tab 134 is then placed against a recess, for example, recess 51*a* of the nut 46. The user then places the finger 130 proximate the nut 46 so that the lower surface 148 of the finger 130 is positioned above or resting on the upper surface 48*a* of the nut 46. As the user begins to rotate the wrench 70 in the counter clockwise direction the engagement tab 134 encounters gripping member 50*a*. As the user continues to rotate the wrench 70, the engagement shoulder 162 of the engagement tab 134 engages the leading shoulder 62 of the gripping member 50*a*. The recess 132 allows the user to visualize the engagement between the shoulder 162 of the engagement tab 134 and the leading shoulder 62 of the gripping member 50*a*. In addition to the engagement between the engagement shoulder 162 and the gripping member 50*a*, the beveled surface 144 and the upright surface 142 of the finger 130 engage the threads of the connector 20.

Figure 5:
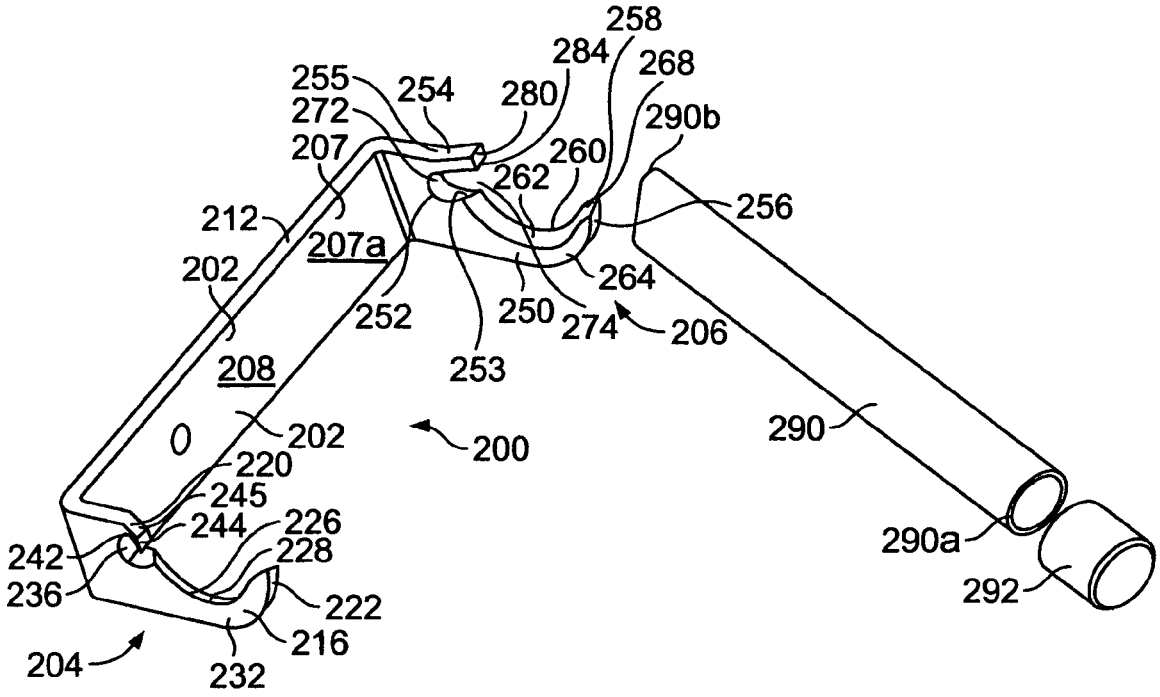
FIG. 5 is a perspective view of a second embodiment of the wrench of the present invention along with a handle.
Figure 5A:
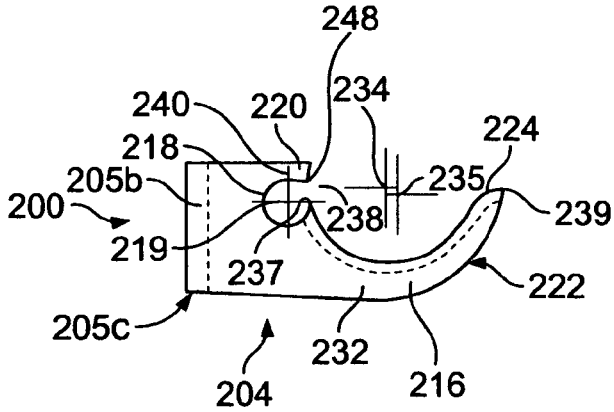
FIG. 5*a* is left end view of the wrench of FIG. 5.
Figure 5B:
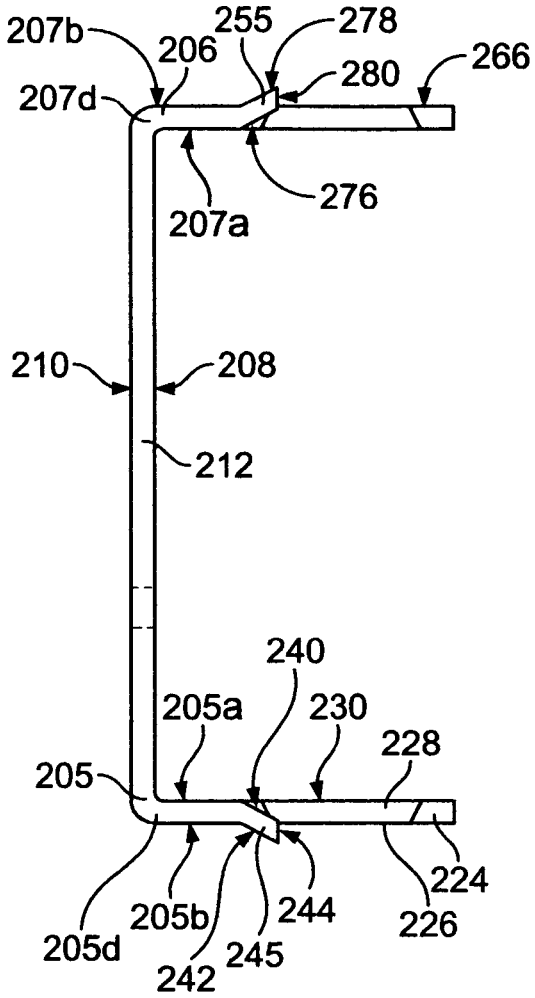
FIG. 5*b* is a top plan view of the wrench of FIG. 5.
Figure 5C:
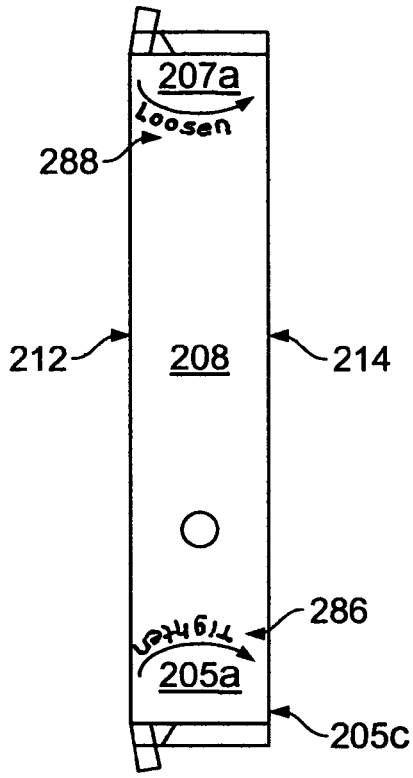
FIG. 5*c* is a rear elevational view of the wrench of FIG. 5.
Figure 5D:
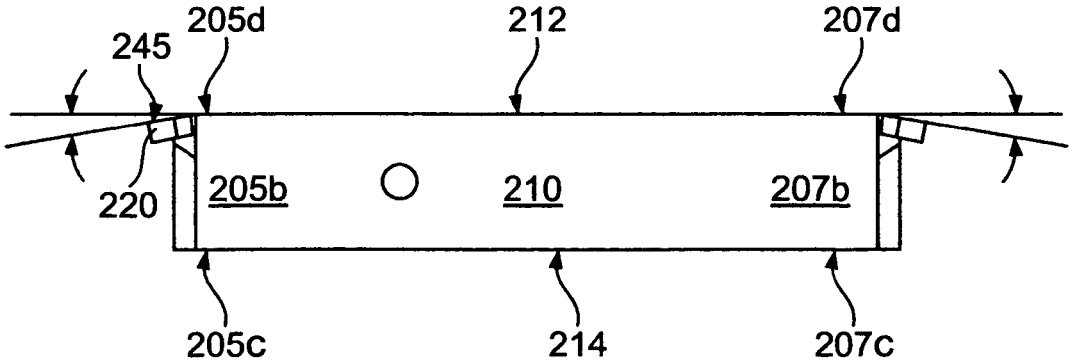
FIG. 5*d* is a front elevational view of the wrench of FIG. 5.

A second embodiment of the wrench is shown in FIGS. 5–5*d*. The wrench 200 generally includes a base portion 202, a tightening end portion 204 and a loosening end portion 206.

The base portion 202 of the wrench 200 is generally elongated and rectangularly shaped. The base portion 202 includes a top surface 208, a bottom surface 210, a front surface 212 and a rear surface 214.

The tightening end portion 204 generally extends perpendicularly to the base portion 202. The tightening end portion 204 generally includes a transition portion 205 an arc shaped finger 216, a relief 218, and an engagement tab 220.

The transition portion 205 is provided between the base portion 202 and the tightening end portion 204. In addition, a concave surface can be provided similar to the concave surface 93 of the first embodiment. In this embodiment, however, a portion of the concave surface would be perpendicular to the top and bottom surfaces 208, 210 and the remainder of the concave surface would be parallel to the tip and bottom surfaces 208, 210. The transition portion 205 includes a top surface 205*a* which extends from the top surface 208 of the base portion 202; a bottom surface 205*b* which extends from the bottom surface 210 of the base portion 202; a rear surface 205*c*; and a front surface 205*d*.

The finger 216 includes a top surface 230, a bottom surface 232, an outer surface 222, an upright surface 226 and a beveled surface 228.

The top surface 230 of the finger 216 extends from the top surface 205*a* of the transition portion 205 and is generally perpendicular to the top surface 208 of the base portion 202. The bottom surface 232 of the finger 216 extends from the bottom surface 205*b* of the transition portion 205 and is generally perpendicular to the bottom surface 210 of the base portion 202.

The outer surface 222 of the finger 216 is generally perpendicular to the upper and lower surfaces 230, 232 of the finger 216. The outer surface 222 extends from the rear surface 205*c* of the transition portion 205 to the upright surface 226. The outer surface 222 is generally convex and is curved relative to an axial center point 234.

The upright surface 226 of the finger 216 is generally perpendicular to the upper and lower surfaces 230, 232 of the finger 216 and extends from the lower surface 232 of the finger 216 and from the outer surface 222 to the relief 218. An end portion 224 of the upright surface 226 extends from the lower surface 232 to the upper surface 230. The upright surface 226 is curved relative to the axial center point 235. A tip 239 is provided at the line where the outer surface 222 of the finger 216 meets the end portion 224 of the upright surface 226.

The beveled surface 228 extends from the upright surface 226 to the upper surface 230 of the finger 216 and from the end portion 224 to the relief 218. The beveled surface 228 is angled relative to the upper surface 230. Preferably the beveled surface 228 is angled 60 degrees relative to the upper surface 230. The beveled surface 228 is curved relative to the axial center point 235.

The relief 218 includes a curved wall 236. The curved wall 236 extends from the upright and beveled surfaces 226, 228 of the finger 216 to the engagement tab 220. A corner 237 is provided where the upright to beveled surfaces 226, 228 meet the curved wall 236. The curved wall 236 extends approximately 315 degrees about an axial center 219.

The engagement tab 220 includes an upper surface 240, a lower surface 242, an end surface 244, and an outer surface 245.

The upper surface 240 of the engagement tab 220 extends from the top surface 205*a* of the transition portion 205 and is angled relative to the top surface 205*a* of the transition portion 205. Preferably the angle provided between the upper surface 205*a* of the transition portion 205 and the upper surface 240 of the engagement tab 220 is approximately 30 degrees. The lower surface 242 extends from the bottom surface 205*b* of the transition portion 205 and is generally parallel to the upper surface 240.

The end surface 244 extends from the upper surface 240 to the lower surface 242 of the engagement tab 220. The end surface 224 also extends from the curved wall 236 of the relief 218 to the outer surface 245 of the engagement tab 220. An engagement shoulder 248 is provided where the end surface 244 meets the curved wall 236 of the relief 218. A gap 238 is provided between the engagement shoulder 248 and the corner 237.

The outer surface 245 of the engagement tab 220 extends from the front surface 205*d* of the transition portion 205. As shown in FIG. 5*d*, the outersurface 245 of the engagement tab 220 is angled, preferably approximately 10 degrees relative to the front surface 205*d*.

The loosening end portion 206 generally extends perpendicularly to the base portion 202. The loosening end portion 206 of the wrench 70 is similar to the tightening end portion 204 of the wrench 70 however the loosening end portion 206 is oriented in a different manner. The loosening end portion 206 of the wrench generally includes a transition portion 207, an arc shaped finger 250, a relief 252, and an engagement tab 254.

The transition portion 207 is provided between the base potion 202 and the loosening end portion 206. The transition portion 207 includes a top surface 207*a* which extends from the top surface 208 of the base portion 202; a bottom surface 207*b* which extends from the bottom surface of the base portion 202; a rear surface 207*c* which extends from the rear surface 214 of the base portion 202; and a front surface 207*d* which extends from the front surface 212 of the base portion 202. In addition, a concave surface can be provided similar to the concave surface 93 of the first embodiment. In this embodiment, however, a portion of the concave surface would be perpendicular to the top and bottom surfaces 208, 210 and the remainder of the concave surface would be parallel to the top and bottom surfaces 208, 210.

The finger 250 includes an upper surface 264, a lower surface 266, an outer surface 256, an upright surface 260 and a beveled surface 262. The outer surface 256 of the finger 250 is generally perpendicular to the upper and lower surfaces 264, 266 of the finger 250. The outer surface 256 extends from rear surface 207*c* of the transition portion 207 to the upright surface 260. The outer surface 256 is generally convex and is curved relative to an axial center point (not shown). A tip 268 is provided at the line where the outer surface 256 of the finger 250 meets the upright surface 260 of the finger 216.

The upright surface 260 of the finger 250 is generally perpendicular to the upper and lower surfaces 264, 266 of the finger 250 and extends from the lower surface 266 of the finger 250 and from the outer surface 256 to the relief 252. An end portion 258 of the upright surface 260 extends from the lower surface 266 to the upper surface 264. The upright surface 260 is curved relative to an axial center point (not shown).

The beveled surface 262 extends from the upright surface 260 to the upper surface 264 of the finger 250 and from the end portion 258 to the relief 252. The beveled surface 262 is angled relative to the upper surface 260. Preferably the beveled surface 262 is angled 60 degrees relative to the upper surface 260. The beveled surface 262 is curved relative to ane axial center point (not shown).

The relief 252 includes a curved wall 272. The curved wall 272 extends from the upright and beveled surfaces 260, 262 of the finger 250 to the engagement tab 254. A corner 253 is provided where the upright and beveled surfaces 260, 262 meet the curved wall 272. The curved wall 272 extends approximately 315 degrees about an axial center (not shown)

The engagement tab 254 includes an upper surface 276, a lower surface 278, an end surface 280, and an outer surface 255.

The upper surface 276 of the engagement tab 254 extends from the top surface 207*a* of the transition portion 207 and is angled relative to the top surface 207*a* of the transition portion 207. Preferably the angle provided between the top surface 207*a* of the transition portion 207 and the upper surface 276 of the engagement tab 254 is approximately 30 degrees.

The lower surface 278 extends from the bottom surface 207*b* of the transition portion 207 and is generally parallel to the upper surface 276.

The end surface 280 extends from the curved wall 272 of the relief 252 to the outer surface 255 of the engagement tab 254. The end surface 280 also extends from the upper to the lower surfaces 276, 278 of the engagement tab 254. An engagement shoulder 284 is provided where the end surface 280 meets the curved wall 272 of the relief 252. A gap 274 is provided between the engagement shoulder 284 and the corner 253.

The outer surface 255 of the engagement tab 254 extends from the front surface 207*d* of the transition portion 207. The outer surface 255 is angled relative to the front surface 207*d* at an angle of approximately 10 degrees.

The angled nature of the wrench 200 makes the wrench 200 particularly useful in tighten and loosening nuts mounted on connectors at the back of an electrical box. The wrench 200 is used to tighten and loosen a nut in the same manner as described with respect to the first embodiment with the following exceptions. An identifier 286 identifies the tightening end portion 204 of the wrench 200 and an identifier 288 identifies the loosening end portion of the wrench 200. When using the wrench 200 to tighten a nut 46, the user can grasp the base portion 202 of the wrench 202.

Alternatively, a handle 290 may be used in connection with the wrench 200. The handle 290 is generally elongated and is formed from a tubular shaped member. A first end 290*a* of the handle 290 is cylindrically shaped. The second end 290*b* of the handle 290 is generally oblong. The second end 290*b* of the handle is formed by pounding the second end 290*b* of the tubular shaped member until opposite sides of the tube are proximate one another but spaced apart. A plastic end cap 292 may be placed over the first end 290*a* of the handle 290 for additional comfort.

When tightening a nut 46, the second end 290*b* of the handle 290 is placed over the finger 250 of the loosening portion 206. The handle 290 provides an extension on which the user can apply rotational forces to the nut 46. When loosening a nut 46, the second end 290*b* of the handle 290 is placed over the finger 216 of the tightening portion 204.

Figure 6:
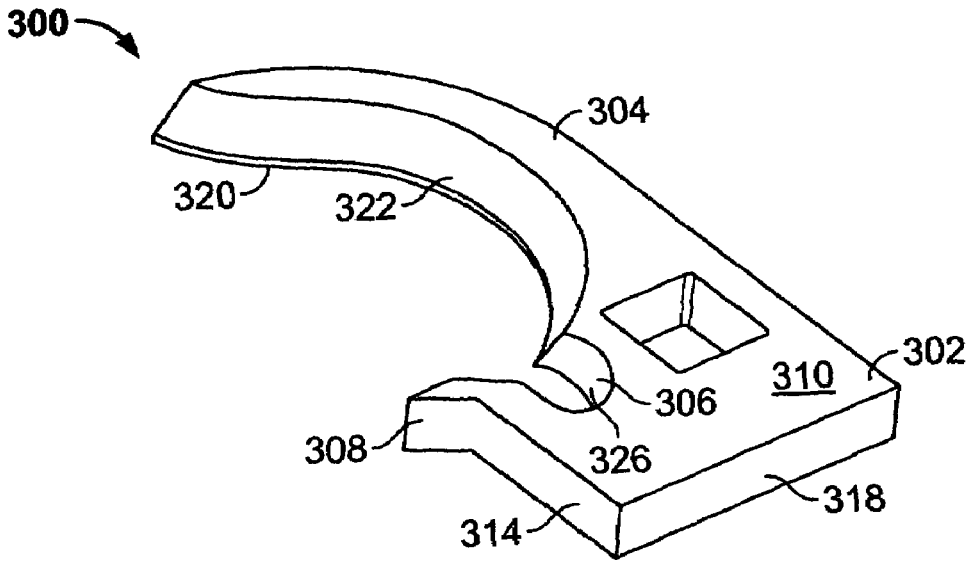
FIG. 6 is a perspective view of a third embodiment of the wrench of the present invention.
Figure 6A:
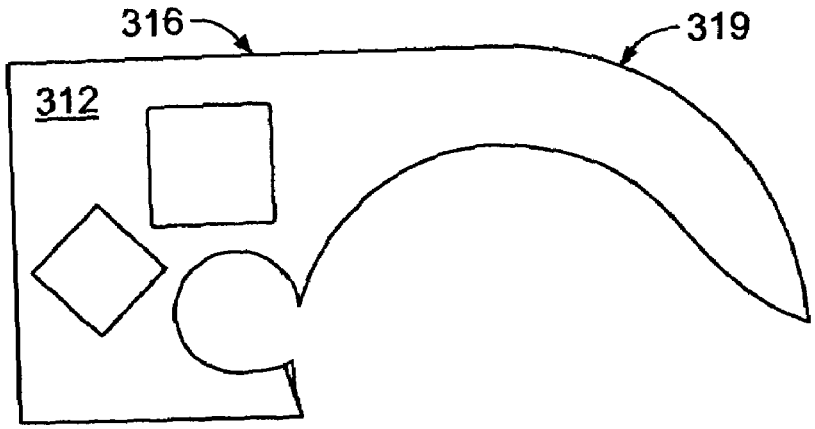
FIG. 6*a* is a bottom plan view of the wrench of FIG. 6.
Figure 6B:
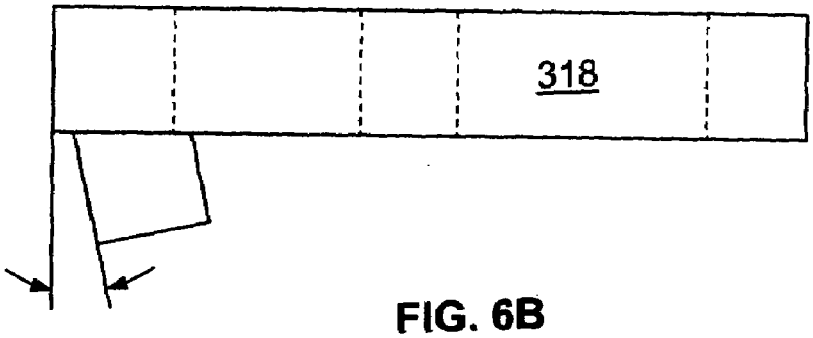
FIG. 6*b* is a right end view of the wrench of FIG. 6.
Figure 6C:
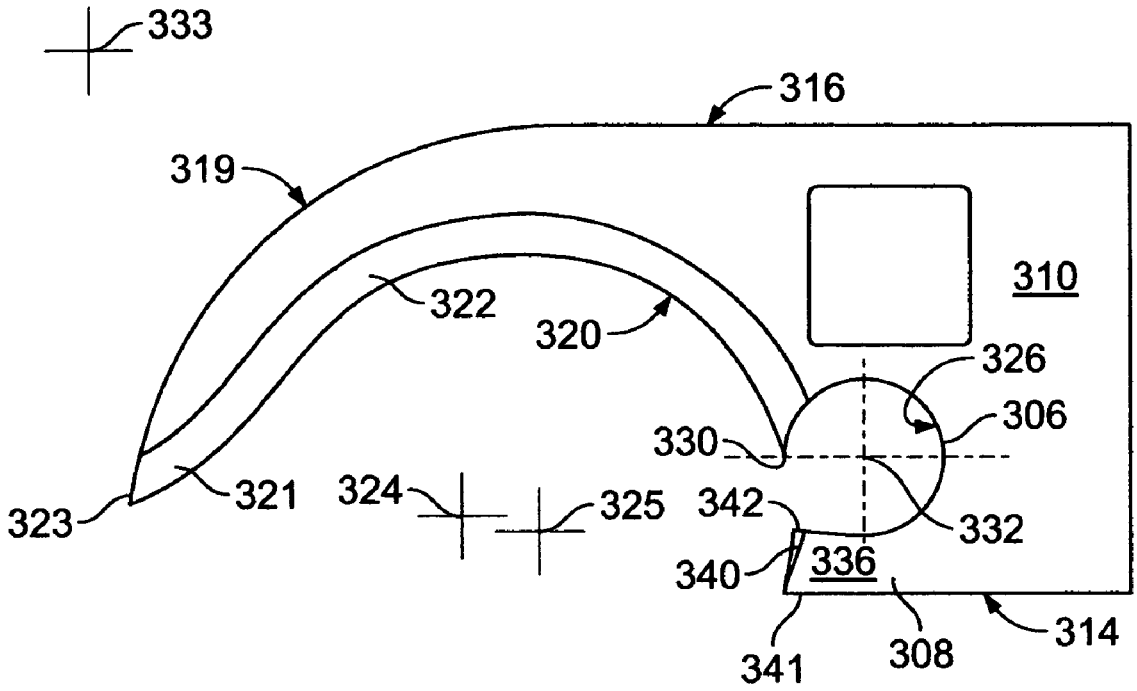
FIG. 6*c* is a top plan view of the wrench of FIG. 6.
Figure 6D:
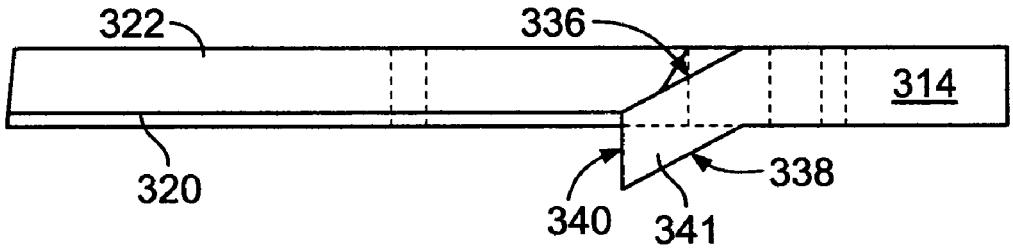
FIG. 6*d* is a front elevational view of the wrench of FIG. 6.

A third embodiment of the wrench is shown in FIGS. 6–6*d*. The wrench 300 is particularly useful when the space surrounding the nut is very limited. The wrench shown in FIGS. 6–6*d* is to be used when loosening the nut. A wrench having the opposite orientation as that shown can be used to tighten a nut.

The wrench 300 includes a base portion 302, a finger 304 extending from the base portion 302, a relief 306, and an engagement tab 308. The wrench 300 also includes a top surface 310, a bottom surface 312, a front surface 314, a rear surface 316 and an end wall 318. The top surface 310 is generally parallel to the bottom surface 312 and the front and rear surfaces 314, 316 are generally perpendicular to the top and bottom surfaces 310, 312.

The finger 304 includes an outer surface 319, an upright surface 320 and a beveled surface 322.

The outer surface 319 of the finger 304 is generally perpendicular to the top and bottom surfaces 310, 312 of the wrench 300. The outer surface 319 of the finger 304 is generally convex and extends from the rear surface 316 to the upright surface 320. The outer surface 319 is curved relative to an axial center point 325.

The upright surface 320 of the finger 304 is generally perpendicular to the top and bottom surfaces 310, 312 of the wrench 300 and extends upwardly from the bottom surface 312 and from the outer surface 318 to the relief 306. An end portion 321 of the upright surface 320 extends from the bottom surface 312 to the top surface 310. The end portion 321 is curved relative to an axial center point 333. The upright surface 320 is curved relative to an axial center point 324. A tip 323 is provided where the outer surface 319 of the finger 304 meets the end portion 321 of the upright surface 320.

The beveled surface 322 extends from the upright surface 320 to the top surface 310 of the wrench 300 and from the end portion 321 to the relief 306. The beveled surface 322 is angled relative to the top surface 310. Preferably the beveled surface 322 is angled 60 degrees relative to the top surface 310. The beveled surface 322 is curved relative to the axial center point 324.

The relief 306 includes a curved wall 326. The curved wall 326 extends from the upright and beveled surfaces 320, 322 of the finger 304 to the engagement tab 308. A corner 330 is provided where the upright and beveled surfaces 320, 322 meet the curved wall 326. The curved wall extends approximately 315 degrees about an axial center 332.

The engagement tab 308 includes an upper surface 336, a lower surface 338, an end surface 340 and an outer surface 341.

The upper surface 336 of the engagement tab 308 extends from the top surface 310 and is angled relative to the top surface 310 of the wrench 300. Preferably the angle provided between the top surface 310 of the wrench 300 and the upper surface 336 of the engagement tab is approximately 30 degrees.

The lower surface 338 extends from the bottom surface 312 and is angled relative to the bottom surface 312. Preferably, the upper surface 336 of the engagement tab 308 is parallel to the lower surface 338 of the engagement tab 308.

The end surface 340 extends from the curved wall 326 of the relief 306 to the outer surface 341 of the engagement tab 308. The end surface 340 also extends from the upper surface 336 to the lower surface 338. An engagement shoulder 342 is provided where the end surface 340 meets the curved wall 326 of the relief 306. A gap is provided between the engagement shoulder 342 and the corner 330.

The outer surface 341 of the engagement tab 308 extends from the rear surface 314 of the wrench 300. The outer surface 341 is angled relative to the rear surface 314 at an angle of approximately 10 degrees.

A nut 46 is loosened from the connector 20 using the wrench 300 in the same manner as that described with respect to the wrench 70 of the first embodiment with the following exception. Rather than grasping the handle portion 80, the user grasps the base portion 302 of the wrench 300 in order to rotate the wrench 300 and the nut 46. An identifier can be engraved on the top surface 310 of the wrench 300 to ensure that the user has achieved the proper orientation of the wrench 300.

The wrench 300 provides access to the severely restricted areas, for example, at the back of an electrical box. The wrench 300 allows the use of standard ¼" socket drive system hardware and is extremely compact. The wrench is particularly useful in connection with mounting lighting fixtures on a ceiling wherein the electrical connections for these fixtures are typically provided at the back of the electrical boxes. In such a situation, physical access to the nut 46 is reduced and clamping onto the nut 46 with a pair of pliers, or attempting to rotate the nut using a screwdriver is not practical. Access to the nut 46 is further complicated when numerous connections are present reducing adjacent clearances for rotation.

It has been found that when the engagement tab 308 is positioned at a 15 degree angle to the fastener's centerline, a greater rotational force can be transmitted to the nut 46 by way of the wrench 300.

The wrench has been engineered to withstand forces many times the strength of the nut. It is manufactured from high strength carbon steel and heat-treated for additional strength and to provide long service. Corrosion resistant plating is added to its surface to minimize oxidation and maintenance. Although, particular dimensions have been described with respect to a ½ inch size wrench, the wrench can be manufactured in any number of sizes for use with a variety of nut sizes.

Although use of the wrench has been described with respect to fastening nuts to electrical conduit connectors, the wrench can be used in a variety of applications in which the article to be rotated and fastened includes spaced gripping members.

The wrench is engineered to achieve the required minimum rotations in all cases when all adjacent positions are filled with connectors. This reduces the amount of time and effort required by the individual to completely secure each connector.

While preferred embodiments of the invention are shown and described, it is envisioned that those skilled in the art may devise various modifications of the present invention.

The invention claims is:

1. A wrench for rotating a nut positioned on a threaded end of a connector, said wrench comprising:

a base portion;

at least one end portion extending from said base portion, said end portion including an arc-shaped finger extending from said base portion, and an engagement tab extending downwardly from said base portion and spaced from said arc-shaped finger.

2. A wrench as defined in claim 1, further including a first end portion and a second end portion, wherein said first end portion is used to tighten the nut on the connector and the second end portion is used to loosen the nut from the connector.

3. A wrench as defined in claim 1, wherein the nut to be rotated includes radially outwardly extending protrusions and wherein; said engagement tab engages a protrusion of the nut.

4. A wrench as defined in claim 3, wherein said nut to be rotated includes an upper surface and a lower surface and wherein when said engagement tab is engaged with the protrusion of the nut said finger is proximate the upper surface of the nut.

5. A wrench as defined in claim 1, wherein an inner surface of said finger is beveled and wherein a portion of said inner surface is positioned within the thread of the connector.

6. A wrench as defined in claim 5, wherein said finger is capable of engaging the thread of the connector to provide a self-locking engagement of said wrench.

7. A wrench as defined in claim 5, wherein a portion of said inner surface of said arc-shaped finger is upright.

8. A wrench as defined in claim 1, further including a concave surface extending from said base portion to said finger.

9. A wrench as defined in claim 1, wherein said at least one end portion is generally planar with said base portion.

10. A wrench as defined in claim 1, further including a relief between said finger and said engagement tab.

11. A wrench as defined in claim 10, wherein said relief is arc-shaped.

* * * * *